United States Patent [19]

Perry

[11] Patent Number: 4,723,325

[45] Date of Patent: Feb. 9, 1988

[54] COMBINATION SWEATBAND AND FACIAL TOWEL

[76] Inventor: Dorothy M. Perry, 4429 Malia St., Honolulu, Hi. 96701

[21] Appl. No.: 943,725

[22] Filed: Dec. 19, 1986

[51] Int. Cl.[4] ..... A42B 0/00

[52] U.S. Cl. ..... 2/207; 2/DIG. 11; 2/181

[58] Field of Search ..... 2/207, DIG. 11, 91, 2/181, 181.8, 209

[56] References Cited

U.S. PATENT DOCUMENTS

| | | |
|---|---|---|
| D. 92,603 | 6/1934 | James . |
| D. 254,637 | 4/1980 | Moore . |
| D. 258,845 | 4/1981 | Moore et al. . |
| 2,167,228 | 7/1939 | Wood . |
| 2,806,222 | 9/1957 | Carpenter . |
| 2,947,992 | 8/1960 | De Villers . |
| 3,060,449 | 10/1962 | Lehnhard . |
| 3,286,276 | 11/1966 | Callisch . |
| 3,668,707 | 6/1972 | Williams . |
| 3,748,661 | 7/1973 | Smith ..... 2/207 |
| 4,520,510 | 6/1985 | Daigle ..... 2/DIG. 11 |

*Primary Examiner*—Doris L. Troutman

[57] ABSTRACT

A combination sweatband and facial wipe comprising a length of soft, absorbent fabric having hemmed edges, the fabric being twisted once about itself and the ends thereof sewn together to form a continuous loop separated by the twist into two loops, one larger than the other, the smaller loop being adapted to encircle the head of a person as a sweatband, with the twist being placed at the back of the head, the larger loop being adapted to drape around the person's neck, shoulder and upper chest for use as a facial wipe, the sizes of the loops being respectively and infinitely adjustable.

12 Claims, 6 Drawing Figures

Fig. 1
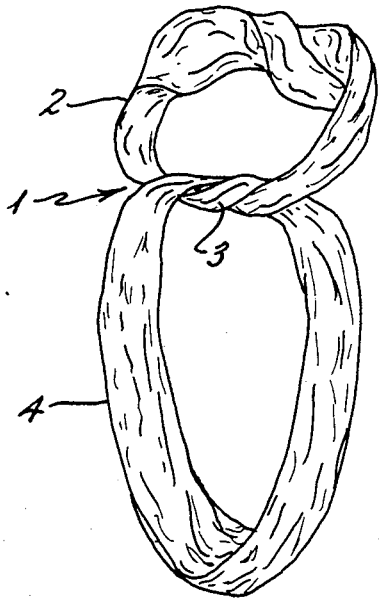
Fig. 2
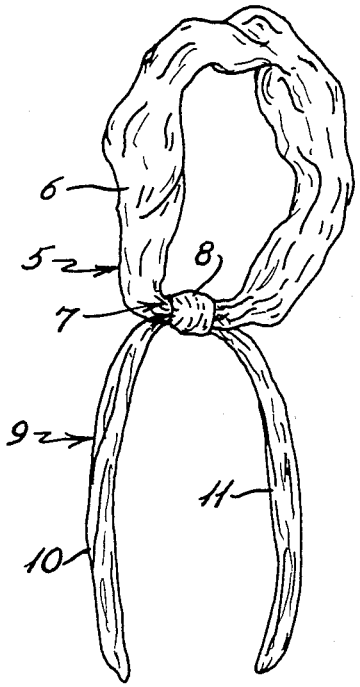
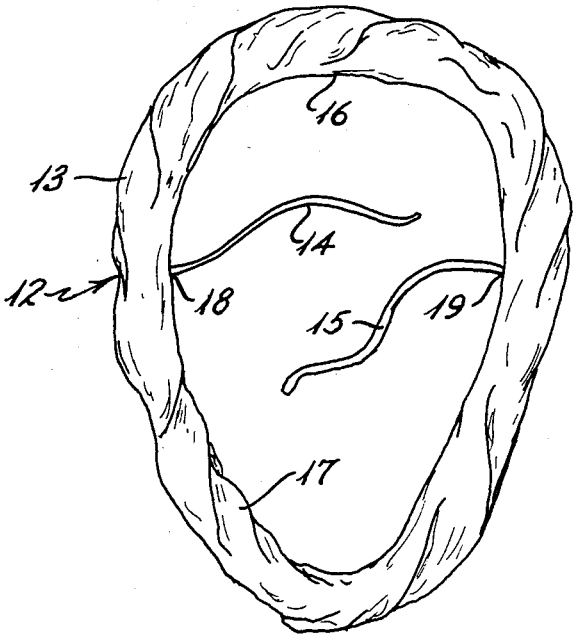
Fig. 3

COMBINATION SWEATBAND AND FACIAL TOWEL

As Americans strive for better health, vigorous activities such as jogging, hiking, cycling, weight training and other athletic endeavors have become more and more popular. In fact, jogging and cycling are close to becoming major national pastimes. As anyone who has engaged in strenuous physical activity know, such exercises causes the body to perspire in an effort to cool itself by evaporative means. While this is not undesirable during athletic exercise, the perspiration emanating from the head and facial areas quite often become annoying in that it drips into the eyes, thereby disrupting vision, or trickles down the face to drip from the nose and chin.

To combat this liquid flow, athletes anddn exercisers have worn individual head bands of various types, from a simple handkerchief knotted around the head to specially made bands of absorbent material, and have carried towels with which to mop the face and neck. The separate towel has presented its own problems in that it must be carried somewhere on the user, usually in the hand, in a pocket, draped around the neck or tucked in the waistband of ones shorts These are all places from which it can become dislodged causing loss or at least disruption of the user's rhythm of exercise in order to retrieve it. The headbands also present drawbacks in that they may not be sufficiently adjustable and therefore too loose or too tight. They may also be of minimal material, no more than a mere strip of cloth that quickly becomes saturated, or of a material that can become irritating.

It is therefore an object of this invention to provide an improved item of apparel for exercisers, athletes and the like.

It is a further object of this invention to provide a combination sweatband and facial towel or wipe.

It is a still further object to provide such an improved item of apparel that is adjustable for all head sizes.

These and other objects will become apparent from the detailed description given hereafter. It should be understood, however, that the detailed description and specific examples, while indicating preferred embodiments of the invention, are given by way of illustration only, since various changes and modifications within the spirit and scope of the invention will become apparent to those skilled in the art.

SUMMARY OF INVENTION

This invention provides a combination sweatband and facial towel or wipe comprising essentially a loop of soft, absorbent fabric adapted to be gathered so as to form a smaller loop for encircling the head and a larger loop hanging around the neck and over the upper chest. Alternatively the main loop may have two straps projecting from one point on its circumference for wrapping and tying about the head, the loop hanging around the neck and over the upper chest.

DESCRIPTION OF DRAWINGS

A more complete understanding of the invention may be had by reference to the following drawings:

FIG. 1 illustrates a first embodiment of the invention.

FIG. 2 illustrates a second embodiment of the invention.

FIG. 3 illustrates a third embodiment of the invention in its open, ungathered state.

DETAILED DESCRIPTION OF DRAWINGS

Figure 4:
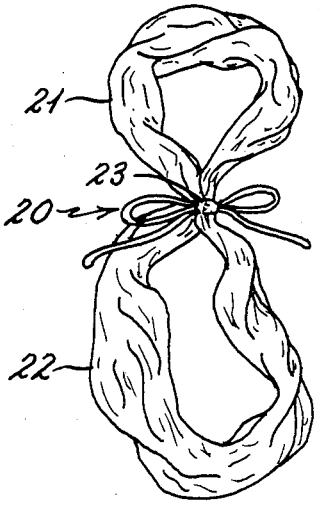
FIG. 4 illustrates the embodiment of FIG. 3 in its gathered state ready for use.

Referring in detail to the drawings, FIG. 1 illustrates the general embodiment 1 of the invention comprising a piece of absorbent fabric, its edges hemmed to prevent unravelling, twisted once about itself 3 and the ends sewn together to form two loops 2 and 4. Owing to the nature of construction these loops and infinitely and respectively adjustable with one loop becoming larger as the other becomes smaller. In use, the smaller loop 2 is placed around the head with the twist portion 3 at the back of the head and the larger loop 4 is draped around the neck and over the shoulders to hang over the upper chest thereby being available for use as a wipe for mopping the face. Pulling the larger loop 4 on either side of the twist portion 3 will tigthen the smaller loop 2 for a snug fit. The piece of fabric is between 15 and 20 inches wide, preferably 17–18 inches, and is naturally bunched or collected to a narrower width at the smaller loop 2, thereby forming a soft, cushioned headband, and which hangs looser and more open in the larger loop 4 providing a wide wiping surface. The length of the cloth is between 50 and 70 inches, preferably 55 to 65 inches, providing sufficient length to be adjustable for various sizes of users without being so short as to be unduly tight around the shoulders and chest or so long as to flop annoyingly or present a danger of getting caught.

FIG. 2 illustrates a second embodiment 5 comprising a loop 6 of fabric between 15 and 20 inches wide with the edges hemmed, and between 45 and 50 inches long adapted to hang around the shoulders and over the chest, the loop 6 formed by sewing the ends of the piece of fabric together. At the point of juncture 7 the piece of fabric is gathered to a narrower width, the rest of the loop being allowed to hang loosely. In place of the smaller loop 2 or embodiment 1, this second form 5 has two narrow elongated strips 10 and 11 formed from a separate piece of fabric between 45 and 50 inches long and between 8 and 10 inches wide that is folded longitudinally and sewn to form a strip 9 that is 1 to 1.5 inches wide. The resulting strip 9 is wrapped around the loop 6 at the point of juncture 7 and knotted 8 to result in strips 10 and 11 that are tied around the head as a head band, the knot 8 being positioned at the back of the head. Forming the strip 9 from a wider piece of fabric produces a strip 9 that is softer, thicker and more absorbent that the single thickness. To keep loop 6 from sliding through the knot 8 the two pieces of fabric forming loop 6 and strip 9 respectively are sewn together at the point of juncture 7.

FIG. 3 illustrates a third embodiment 12 comprising a continuous loop 13 of fabric between 15 and 20 inches wide, preferably 17–18 inches, and between 50 and 70 inches long, preferably 55 to 65 inches. For part of its length the loop 13 of fabric has been folded to a double thickness and sewn together along the edge 16 to form the headband portion. The remaining portion 17 of loop 13 is left as a single thickness and comprises the greater portion of the loop 13 forming a facial wipe. Tie strings 14 and 15 are attached to the loop 13 at the end points 18 and 19, respectively, of the stitched edge 16 and are used to gather and hold loop 13 together in the configuration 20 shown in FIG. 4. The ties 14 and 15 are wrapped around the loop 13 and tied 23 to form the smaller head band loop 21 of the double thickness portion and the larger facial wipe loop 22 of single thickness. When worn, the smaller loop 21 is placed around the head with the tied point 23 at the back of the head and the larger loop 22 hanging over the shoulders and across the chest.

Figure 5:
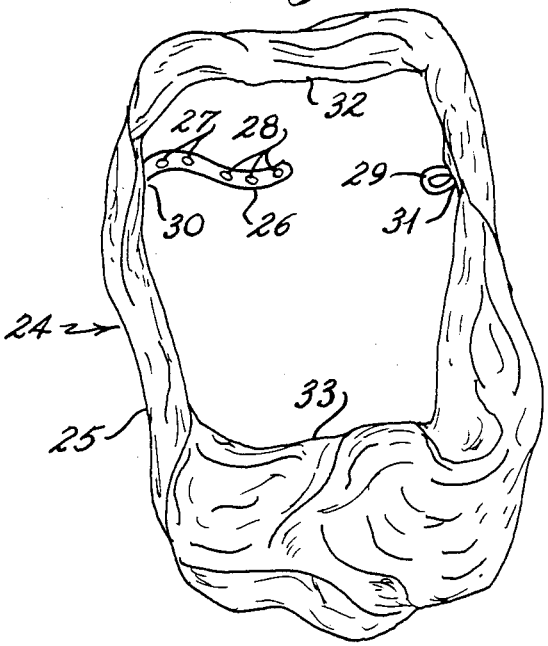
FIG. 5 illustrates a fourth embodiment of the invention in its open, ungathered state.
Figure 6:
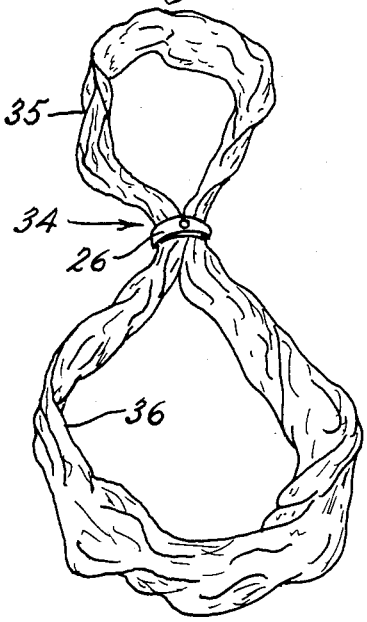
FIG. 6 illustrates the embodiment of FIG. 5 in its gathered state ready for use.

FIG. 5 illustrates a fourth embodiment 24 comprising a continuous loop of fabric 24 as in the previous embodiment 12. As before, the greater part 33 of the loop 25 is a single thickness of fabric that drapes over the shoulders and across the chest while the smaller portion is folded in half, in this case three times longitudinally, and stitched along the edge 32 to form a padded portion. As seen in FIGURE 6 these portions will form the facial wipe 36 and the head band 35, respectively. To maintain the loop 25 in the in use configuration 34 as shown in FIG. 6, a strap 26 and small loop 29 are sewn to the loop 25 at points 30 and 31 respectively. These points 30 and 31 correspond to the ends of the stitched edge 32. Strap 26 is provided with a plurality of snap closures along its length in a pattern consisting preferrably of at least two female parts 27 on one side of the strap 26 towards its inner end and at least two male parts 28 on the opposite side of the strap 26 and toward its outer end. The operation of the strap 26 makes this arrangement necessary since, to put the embodiment 24 into its in use configuration 34, the strap 26 is passed through the small loop 29 then folded back and around the loop 25, so as to expose one part of the snap fasteners, then over itself again with the other part of the snap fasteners in registration with the first part such that they may be secured together. In this manner the headband 35 and the facial wipe 36 are formed from the continuous loop 25. The method of use is the same as in embodiment 12. Alternatively, the male and female snap means 27 and 28 may be replaced by hook and loop, Velcro-type fastening means.

In all embodiments of the invention, the fabric is a soft, absorbent, strong woven or knitted fabric, such as a jersey knit, that is easily laundered and all raw edges are hemmed or sewn to prevent unravellilng. It is understood that the specific forms and exemplary descriptions set forth herein before are for the purposes of description only and I do not wish to be limited thereto, but rather by the scope of the appended claims.

What is claimed is:

1. A combination sweatband and facial wipe comprising a length of soft, absorbent fabric having hemmed edges, which is twisted once about itself and the ends sewn together to form a continuous loop separated by said twist into two loops, one of which is normally smaller and the other of which is normally larger, with said smaller loop adapted to encircle the head as a sweatband, said twist being placed at the back of the head, and said larger loop adapted to drape around the neck, shoulders, and upper chest for use as a facial wipe, said smaller and larger loops being infinitely and respectively adjustable, the one becoming larger as the other becomes smaller and vice versa.

2. A combination sweatband and facial wipe as in claim 1 wherein said length of fabric is between 15 and 20 inches wide and between 50 and 70 inches long.

3. A combination sweatband and facial wipe comprising a loop of soft, absorbent fabric adapted to hang around the neck, over the shoulders and across the upper chest and having knitted thereabout at one point a strip of said fabric, the point of knotting of said strip being at or about its center, thereby forming two strips of sufficient length for tying about the head as a sweatband, said strip being sewn to said loop at the point of knotting to prevent its slipping.

4. A combination sweatband and facial wipe as in claim 3 wherein said loop is formed from a piece of soft, absorbent fabric having a width of between 15 and 20 inches, the raw edges hemmed, and a length of between 45 and 50 inches, the ends thereof being sewn together and this portion being gathered to a narrower width and further sewn, the rest of said loop being allowed to hang free and ungathered.

5. A combination sweatband and facial wipe as in claim 4 wherein said strip for encircling the head is formed from a piece of fabric having a length of between 45 and 50 inches and a width of between 8 and 10 inches which width is further reduced to between 1 and 1.5 inches by folding said piece of fabric longitudinally and sewing to form said strip, said strip being knotted about and sewn to said loop at said gathered portion.

6. A combination sweatband and facial wipe comprising a continuous loop of soft, absorbent fabric having means for gathering said loop together at one point to form a smaller loop for encircling the head as a sweatband and a larger loop for hanging loosely about the neck, shoulders, and upper chest for use as a facial wipe, said smaller loop characterized by being at least a double thickness of the fabric formed by folding that portion of said loop longitudinally and sewing together the free edges, said means for gathering being secured to said loop at the respective ends of said at least double thickness portion, said larger loop being an open single thickness of said fabric.

7. A combination sweatband and facial wipe as in claim 6 wherein said continuous loop is formed from a piece of fabric having a width of between 15 and 20, the raw edges being hemmed, and a length of between 50 and 70 inches.

8. A combination sweatband and facial wipe as in claim 7 wherein said gathering means comprises a pair of elongated tie strings adapted to be wrapped around said continuous loop and tied together thereby forming said larger and said smaller loops.

9. A combination sweatband and facial wipe as in claim 7 wherein said gathering means comprises a strap and small loop secured at opposite ends of said at least double thickness portion, said strap adapted to pass through said small loop then pass back over itself and around said continuous loop to lay over itself once again and be secured thereto by fastening means thereon.

10. A gathering means as in claim 9 wherein said fastening means comprises a plurality of snap fasteners, the male and female parts being on opposite sides and opposite ends of said strap so as to be in registration when said strap is wrapped around said continuous loop.

11. A gathering means as in claim 9 wherein said fastening means comprises a hook and loop, Velco-type fastener wherein said hook portion is on the opposite side and end of said strap from said loop portion so as to be in registration when said strap is wrapped around said continuous loop.

12. A combination sweatband and facial wipe as in claim 7 wherein said smaller loop is an eight ply thickness of said fabric formed by folding said smaller loop portion in half three times longitudinally and sewing the free edges together between the two halves of said gathering means.

* * * * *